US007234687B2

(12) United States Patent
King

(10) Patent No.: US 7,234,687 B2
(45) **Date of Patent: *Jun. 26, 2007**

(54) GUARDRAIL SUPPORT, ATTACHMENT, AND POSITIONING BLOCK

(75) Inventor: David T. King, Elizabethtown, KY (US)

(73) Assignee: K.E.S.S. Inc., Elizabethtown, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/081,821

(22) Filed: Mar. 16, 2005

(65) Prior Publication Data

US 2005/0242334 A1 Nov. 3, 2005

Related U.S. Application Data

(63) Continuation-in-part of application No. 10/885,398, filed on Jul. 6, 2004, and a continuation-in-part of application No. 10/385,006, filed on Mar. 10, 2003, now abandoned.

(51) Int. Cl.
*E01F 15/00* (2006.01)

(52) U.S. Cl. ..... 256/13.1; 404/6; 404/9

(58) Field of Classification Search ..... 256/13.1; 404/6, 9; 24/570; 52/729.1, 736.2
See application file for complete search history.

(56) References Cited

U.S. PATENT DOCUMENTS

| | | | | |
|---|---|---|---|---|
| 3,493,213 | A * | 2/1970 | Ackerman | 256/13.1 |
| 6,007,269 | A * | 12/1999 | Marinelli | 404/6 |
| 6,168,346 | B1 * | 1/2001 | Ernsberger | 404/6 |
| 2002/0053664 | A1 * | 5/2002 | Moore | 256/13.1 |

* cited by examiner

*Primary Examiner*—Daniel P. Stodola
*Assistant Examiner*—Michael P. Ferguson
(74) *Attorney, Agent, or Firm*—Carrithers Law Office, PLLC; David W. Carrithers

(57) ABSTRACT

A block used to space guardrails from support posts. The positioning or spacer block is a generally rectangular block having corded-out cavities to reduce weight and tabs or projections for cooperatively engaging the sides and top of a support post as well as the edges of the guardrail during roadway safety barrier system installation. Webbing within one or more of the cavities is used for additional structural support. The spacer block may be formed by low-pressure injection molding to optimize the strength to weight characteristics of the spacer block. The spacer block is formed from virgin and/or recycled plastic material and/or includes virgin or recycled rubber material, such as that obtained from the regrind of used tires, and/or another elastomeric materials from other sources.

7 Claims, 7 Drawing Sheets

FIG. 8
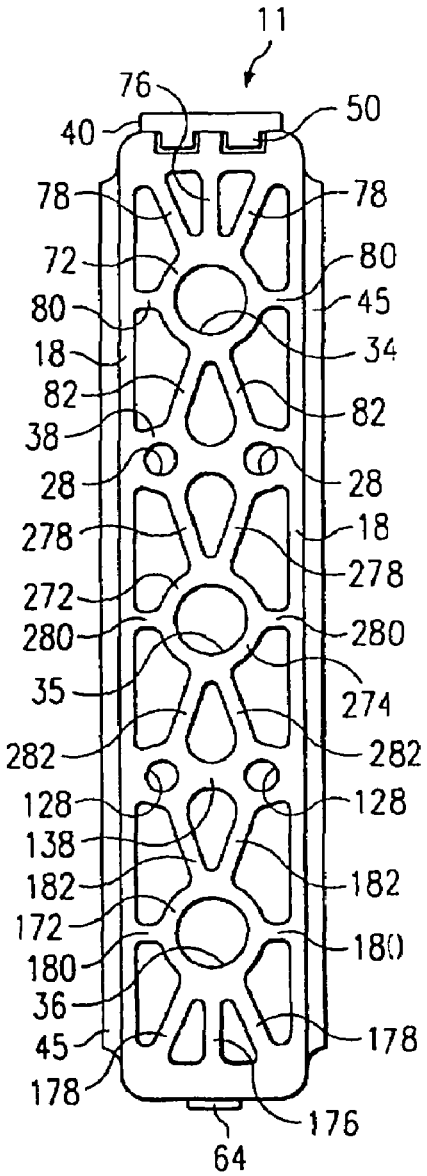
FIG. 9
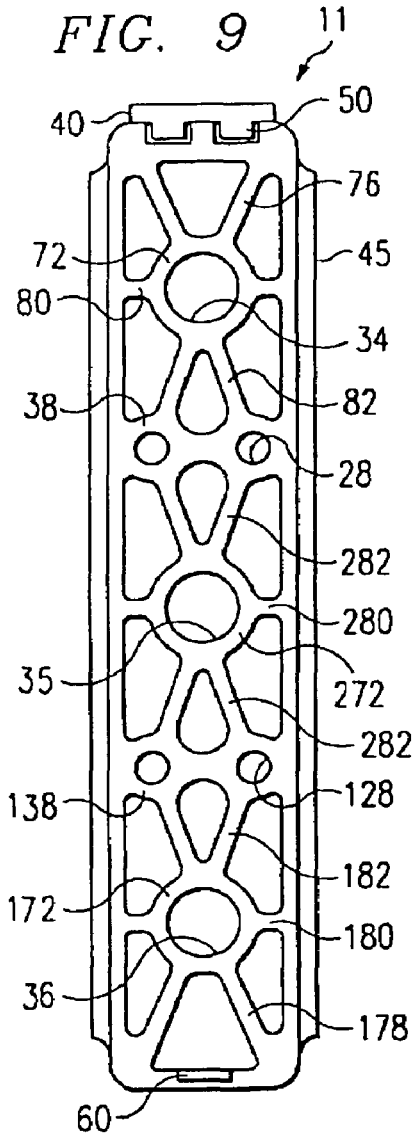
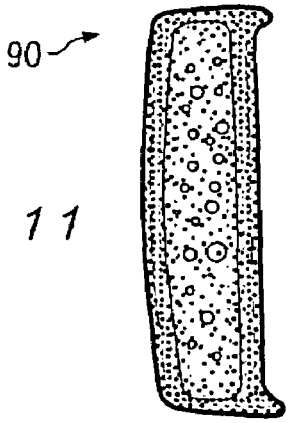
FIG. 11

GUARDRAIL SUPPORT, ATTACHMENT, AND POSITIONING BLOCK

RELATED APPLICATIONS

This application is a continuation-in-part of U.S. patent application Ser. No. 10/885,398 filed on Jul. 6, 2004; and U.S. patent application Ser. No. 10/385,006 filed on Mar. 10, 2003 now abandoned; which claim priority from U.S. Pat. No. 6,530,560 which issued on Mar. 11, 2003 from U.S. patent application Ser. No. 10/079,280 filed on Feb. 19, 2002 and U.S. Pat. No. 6,758,627 which issued on Jul. 6, 2004 from U.S. application Ser. No. 10/001,903 filed on Nov. 15, 2001 which claims priority from U.S. Provisional Application Ser. No. 60/249,037 filed on Nov. 15, 2000 all of which are incorporated by reference herein.

TECHNICAL FIELD OF THE INVENTION

The present invention relates generally to highway safety systems and, more particularly, to spacer blocks for attachment of guardrails to support posts.

BACKGROUND OF THE INVENTION

Guardrails are typically installed along highways as components in roadway safety barrier systems. The guardrails commonly used are usually formed as strips of material, typically twelve (12) gauge galvanized steel. Other materials commonly used in guardrail fabrication include aluminum, steel, fiberglass, or even synthetic materials. Most segments of guardrail are approximately twelve (12) feet in length and about ninety (90) pounds in weight.

At least one configuration of a guardrail used includes a corrugation forming an undulating cross section. The undulating cross section is employed in its capacity to absorb energy from the impact of an out of control vehicle. Such energy absorption is desired in an effort to prevent the vehicle from leaving the roadway or at least to influence the direction of the vehicle prior to it leaving the roadway. Typically, corrugated beams are about nine (9) inches wide, have two crowns and are shaped substantially like the letter "W". An alternate corrugated guardrail embodiment is known in the industry as a thrie-beam guardrail. Thrie-beam guardrails typically have three crowns and are generally about one-third (⅓) wider than a conventional, two-crown, or "W", guardrail.

In most roadway safety barrier systems, a plurality of guardrails are typically linked together at their distal ends, either end to end, or overlapping, and are supported by a plurality of vertically oriented support posts. Among the support post configurations typically used are "I-beam," round or square posts. The support posts used may be fabricated from a variety of materials including wood, metals such as aluminum, steel, etc. Some support posts may also be formed from polymer or fiberglass materials. In place, driven into the ground a distance from the edge of the roadway and from one another, the support posts will typically yield under a certain amount of pressure either by moving within the ground or by bending in accordance with the deformation of the guardrail. Preferably, the support posts do not break off at ground level. Yielding or bending is preferred in an effort to assist the guardrail in dissipating the impact force received from an out of control vehicle.

In a typical roadway safety barrier system, a spacer block is disposed between the guardrail and the support post such that the guardrail may be maintained a distance from the support post. The spacing provided by the spacer block preferably helps keep an automobile's wheels from coming into contact with the support posts and initiating a roll of the vehicle. In addition, the guardrail provides a rail or track for guiding the vehicle and providing at least some response time for the driver to regain control of the vehicle.

Conventional spacer blocks are typically made of wood. However, wood as a material for spacer blocks has many shortcomings. Among wood's shortcomings as a spacer block material are that it deteriorates over time, it is excessively heavy, it can give installers splinters and it typically contracts and expands with seasonal changes. In addition, wood tends to leach out the chemicals typically used for pressure treatment, which chemicals may be toxic to the environment. While there are some plastic spacer block substitutes on the market, they are generally deficient in that they are typically wood block designs formed from plastic.

In most installation instances, it requires two to three people to attach a twelve (12) foot section of guard railing to support posts when using conventional spacer blocks. In the effort, installation typically requires one person to hold the guardrail while another person aligns and holds the spacer block in position. A third person is often required to insert bolts or other attachment means through each system piece for securitization thereof.

SUMMARY OF THE INVENTION

In accordance with teachings of the present disclosure, a guardrail support, attachment and positioning block is provided. In one embodiment, the block preferably includes a pair of side-walls coupled to a top and a bottom panel, thereby forming a generally rectangular block having first and second faces. The block preferably further includes, among other components, at least one mounting bore for coupling a guardrail to a support post. The block preferably also includes an engagement mechanism operable to engage the block with the support post and a resting mechanism operable to support the guardrail during assembly.

In another aspect of the present invention, a method of manufacturing a spacer block for attaching a guardrail to a support post is provided. The method preferably includes forming a block, forming a first aperture through the block and positioning an engagement mechanism on the block, the engagement mechanism preferably being operable to retain the block proximate a mounting position during assembly of a roadway safety barrier system.

In yet another aspect, the present invention provides a guardrail support assembly. The guardrail support assembly preferably includes a support post and a spacer block. The spacer block preferably includes, among other characteristics, a top tab operable to engage the support post and maintain the spacer block in position.

In a further aspect, the present invention provides a method for assembling a roadway safety barrier system. The method preferably includes, among other steps, engaging a tab on a spacer block with a support post such that the spacer block is retained proximate a mounting position. The method preferably also includes engaging at least a portion of a guardrail with a support mechanism on the spacer block such that the guardrail segment may be retained in position proximate the mounting position.

In another aspect, the present invention provides a roadway safety barrier system. The roadway safety barrier system preferably includes a guardrail, a support post and a spacer block coupled together by one or more attachment mechanisms. The spacer block preferably includes, among other elements, a positioning mechanism operable to depend the spacer block from the support during assembly of the roadway safety barrier system.

Further, the present invention provides a spacer block having improved strength, reduced weight, and competitive cost. In addition, the spacer block of the present invention, designed with the assembly process in mind, enables an individual installer to erect and install a guardrail safety barrier system using spacer blocks supported by posts.

Plastic properties are different from those of wood. The present invention takes advantage of these different properties through the use of a new spacer block design. The spacer block of the present invention may employ plastic (polyethylene, PVC, polypropylene polyethylene terephthalate, nylon), plastic/rubber, as well as other materials in its construction. Through the use of such materials, the present invention provides a more resilient, elastic and flexible spacer block that is generally impervious to weathering, has increased longevity, and requires little or no maintenance once installed.

Another preferred embodiment provides for a spacer block for attaching a guard rail to a post including a pair of spaced apart opposing side walls having respective first ends and second ends, a top panel disposed proximate the first end of the side walls, and a bottom panel disposed proximate the second end of the side walls. The top panel, the bottom panel, and the side walls form a generally rectangular block having a first front face and a second rear face. A post engagement mechanism defining at least one projecting member such as a tab extends from the either the second face or the top panel of the block. The engagement mechanism is operable to engage the block with the post. Preferably, the engagement mechanism including a tab operably coupled to the top panel, wherein the tab extends perpendicular to and beyond the second face of the spacer block. In one preferred embodiment, at least one finger and preferably at least two spaced apart fingers operably coupled proximate a distal end of the tab wherein at least one of the fingers extend downward from a bottom surface of the tab. The embodiment using a pair of tabs or a pair of fingers extending from a single tab, or a split tab having a pair of fingers form a gap between the fingers and the second face of the spacer block. Of course where the tab is split or at least two tabs are used each having a finger, a gap exists between the fingers operable to engage respective sides of a web on an I-beam support post and the gap between the fingers and the second face of the spacer block operable to engage respective sides of a flange on the I-beam support post. Thus, by using a single split tab with two fingers or at least a pair of tabs each one having at least one finger, means is provided for the block to operably engage the post. It is contemplated that a tab having a finger projection could also be split or cut to form a groove to cooperatively engage the webbing as well. It is contemplated that a portion of the top tab which extends outward from and normal to the block face could be formed having a groove or slot on the underside thereof for cooperative engagement with the webbing on the top of the post. In addition, an alignment mechanism operably coupled to at least one side wall is included which extend beyond the side of the block to cooperatively engage at least one side of the post. At least one mounting bore extending through the block from the first front face to the second rear face.

It is an object of the present invention to provide a spacer block enabling one person to install a roadway safety barrier system.

It is another object of the present invention to provide a spacer block which is splinter-less, has a longer life span and is lighter than wood.

It is yet another object of the present invention to provide a plastic/rubber composite spacer block that meets all required specifications set forth by the Federal Highway Administration.

It is still another object of the present invention to provide a spacer block that is environmentally friendly and capable of being manufactured using recycled plastic, tires, and/or combinations thereof.

It is still another object of the present invention to provide a plastic-rubber composite spacer block that will meet or exceed the capabilities of today's wooden block.

Yet another object of the present invention is to provide a spacer block embodiment that may be formed from structural foam in order to optimize the weight to strength characteristics of the spacer block.

Other objects, features, and advantages of the invention will be apparent from the following detailed description taken in conjunction with the accompanying drawings showing a preferred embodiment of the invention.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 8 is a plan view showing a spacer block for use with a thrie-beam guardrail and utilizing a webbed reinforcement arrangement similar to that used in the spacer block shown in FIG. 6 according to teachings of the present invention;

FIG. 9 is a plan view showing a spacer block for use with a thrie-beam guardrail and utilizing a webbed reinforcement arrangement similar to that used in the spacer block shown in FIG. 7 according to teachings of the present invention;

FIG. 11 is a top view, in section, showing a spacer block having a cellular core and an integrated solid skin on each side thereof according to teachings of the present invention;

DETAILED DESCRIPTION OF THE INVENTION

Preferred embodiments of the invention and its advantages are best understood by referring to FIGS. 1 through 15 of the drawings, like numerals being used for like and corresponding parts of the various drawings.

Figure 1:
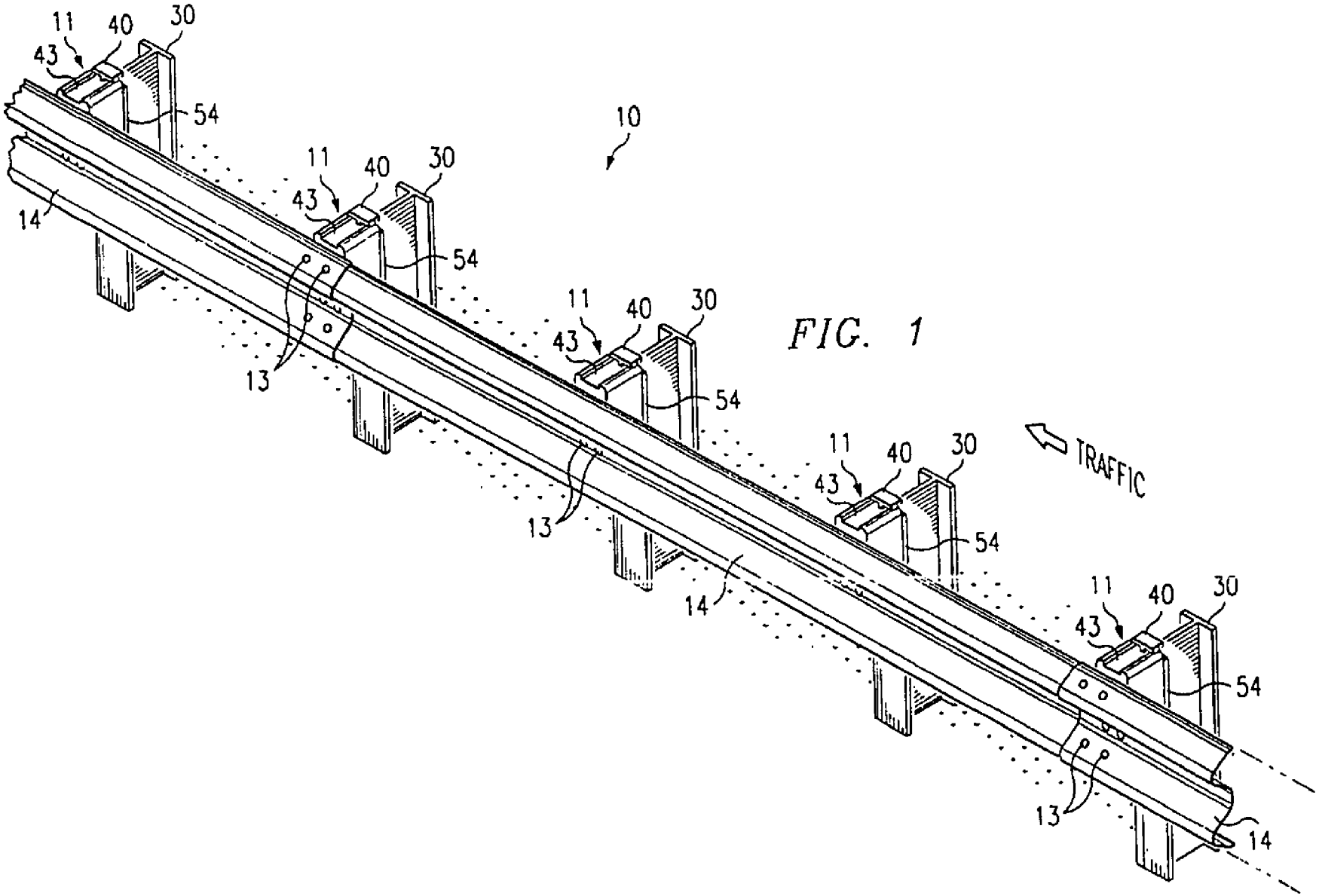
FIG. 1 is a perspective view showing a two crown guardrail roadway safety barrier system according to teachings of the present invention.
Figure 2A:
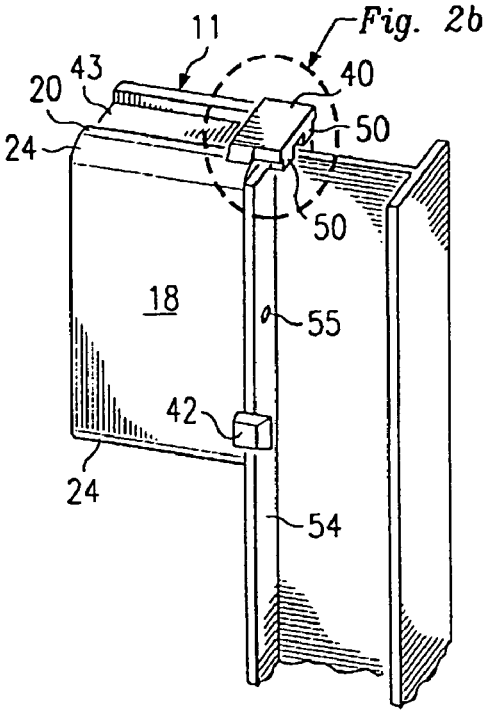
FIG. 2*a* is a perspective view showing a guardrail support assembly according to teachings of the present invention.
Figure 2B:
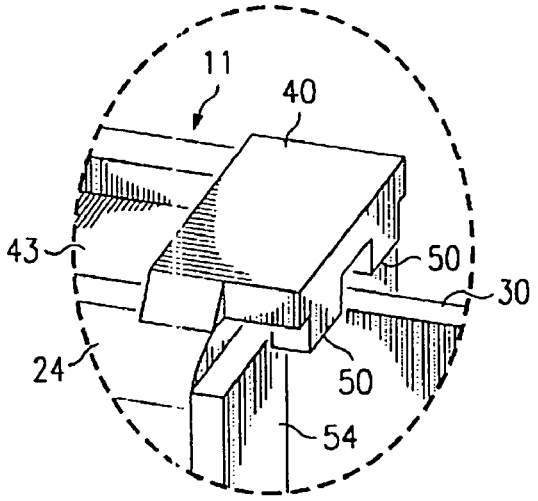
FIG. 2*b* is an expanded view showing the engagement or positioning mechanism of the spacer block illustrated in FIG. 2*a* according to teachings of the present invention.
Figure 15:
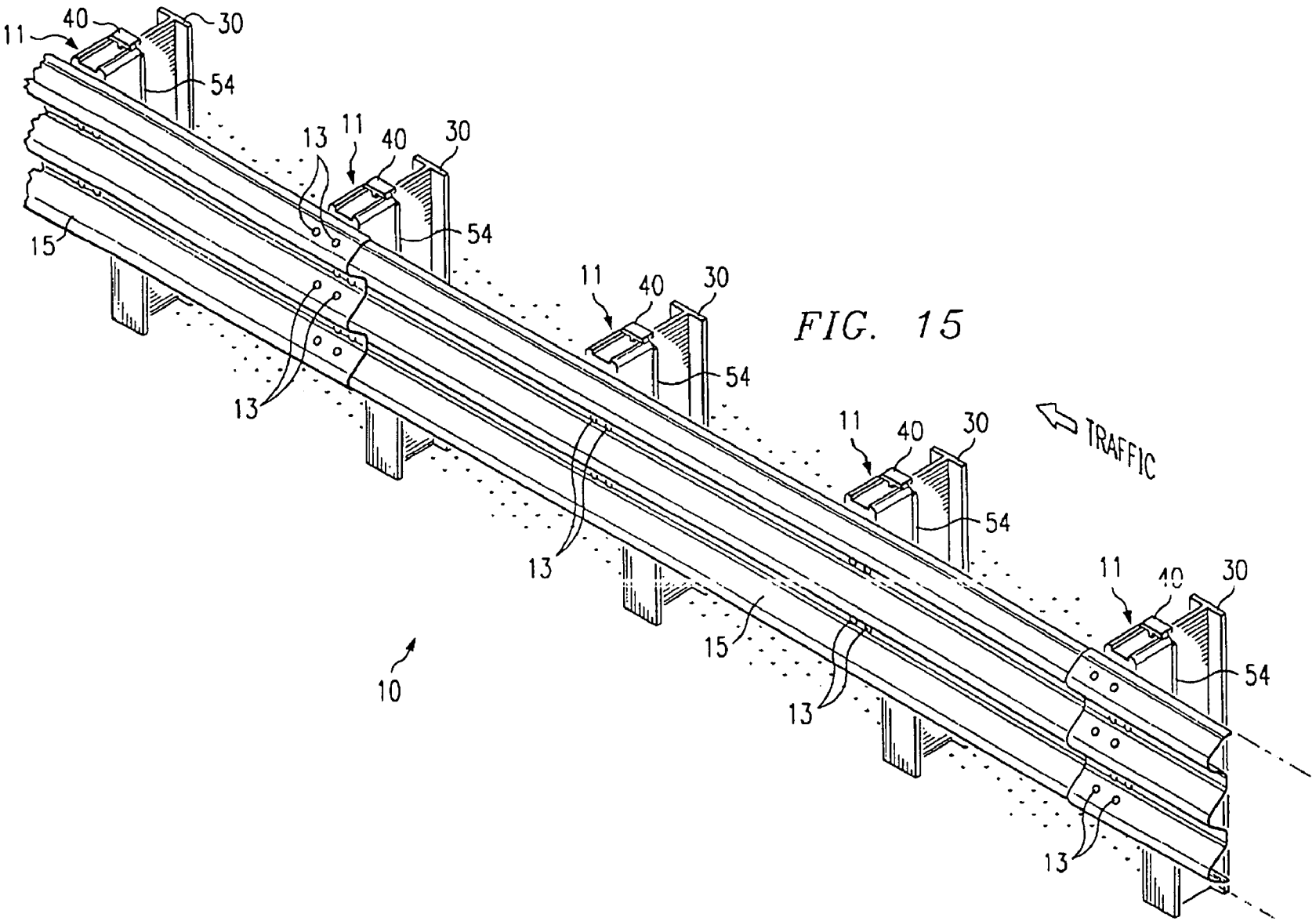
FIG. 15 is a perspective view showing a roadway safety barrier system incorporating thrie-beam guardrails according to teachings of the present invention.

As illustrated in FIGS. 1 through 2*b*, spacer block 11 of the present invention may be mounted to a support post 30, such as an I-beam support post, such that spacer block 11 may cooperatively engage and support a guardrail segment 14 thereon. The roadway safety barrier system 10 of FIG. 1 preferably includes a plurality of spacer blocks 11, support posts 30 and guardrail segments 14. An alternate embodiment of roadway safety barrier system 10 and spacer block 11 for use with thrie-beam guardrail segments 15 is illustrated in FIG. 15 and described in further detail below.

In FIGS. 1 through 4, spacer block 11 is shown with a removable and slidable top tab 40 for engaging a top edge of support post 30. Side tabs 42, illustrated in FIGS. 2*a*, 3 and 4, for preventing lateral movement of spacer block 11 may also be included. In one embodiment, guardrail 14 preferably rests on a bottom or support tab 64, illustrated in FIG. 4, extending from front face 12 of spacer block 11. During installation, bottom tab 64 preferably aids in the support and alignment of guardrail 14 for attachment to support post 30 with one or more attachment mechanisms 13 (e.g., bolts) extending through holes or mounting bores 28 of spacer block 11 and support post 30. Conventional I-beam support posts 30 generally have at least one hole punched into a flange 54 on one side of the support post 30 as illustrated in FIG. 2*a*.

A spacer block 11 for use with conventional two crown ("W") guardrails or other conventional longitudinal rail members is generally shown in FIGS. 1 through 6, 7, 10 and 12 through 14. Such a spacer block 11 is preferably about four (4) inches wide, about seven and one-half (7½) inches deep, and about fourteen (14) inches long.

A spacer block 11 formed in accordance with teachings of the present invention preferably includes front face 12. Front face 12 may be a generally flat solid surface. Alternatively, front face 12 may be webbed, curved, corrugated or formed to correspond to the shape of a guardrail 14. Similarly, rear face 16 may be concave or include a longitudinal depression operable to fit around support posts 30.

Front face 12 is preferably connected to rear face 16 by a pair of spaced apart, opposing side-walls 18 as well as a top panel 20 and a bottom panel 22. The interconnections between side-walls 18, top panel 20, and bottom panel 22 may have rounded shoulders 24, see FIGS. 1 through 4, or squared shoulders 26, see FIG. 5.

Figure 3:
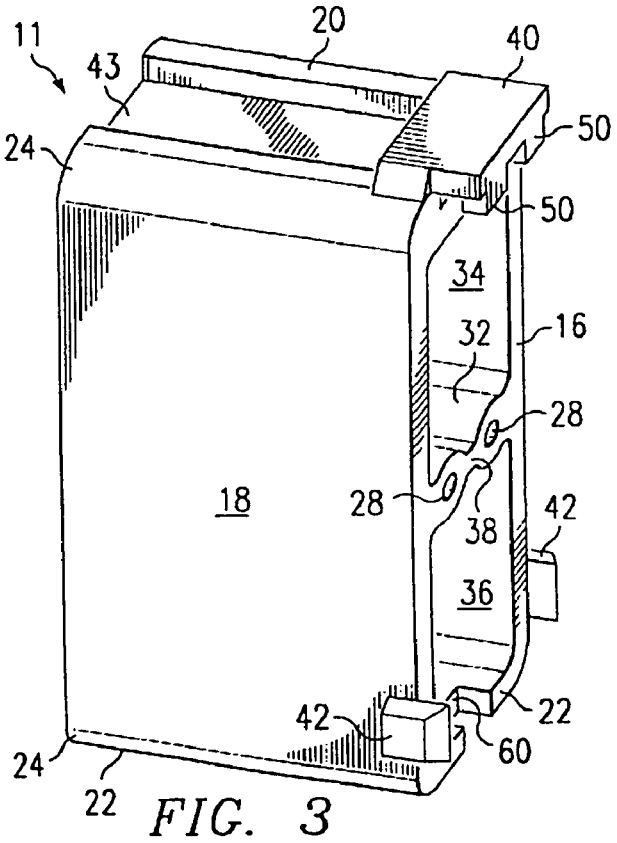
FIG. 3 is a perspective view showing a rear and side of one embodiment of a spacer block according to teachings of the present invention.
Figure 5:
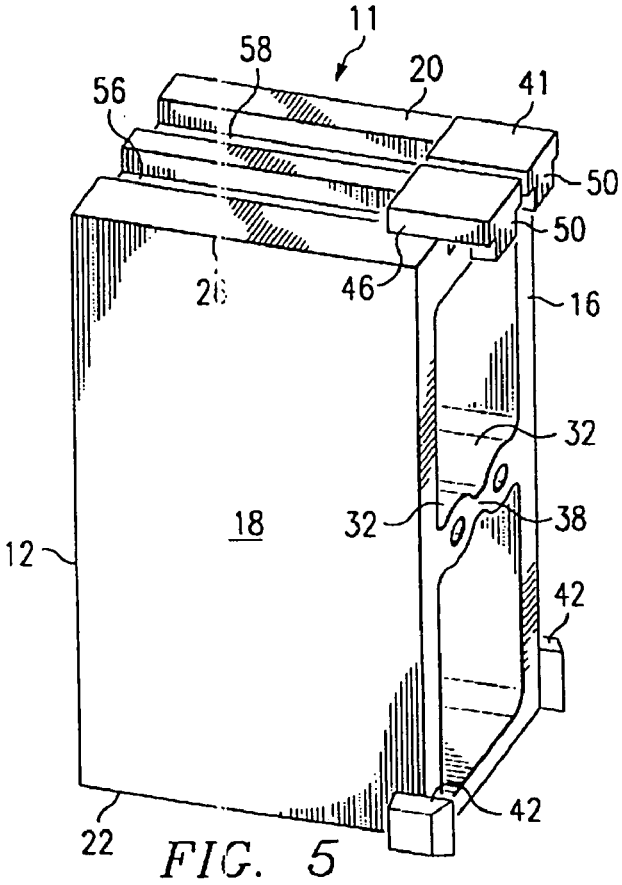
FIG. 5 is a perspective view showing an alternate embodiment of a spacer block according to teachings of the present invention.
Figure 12:
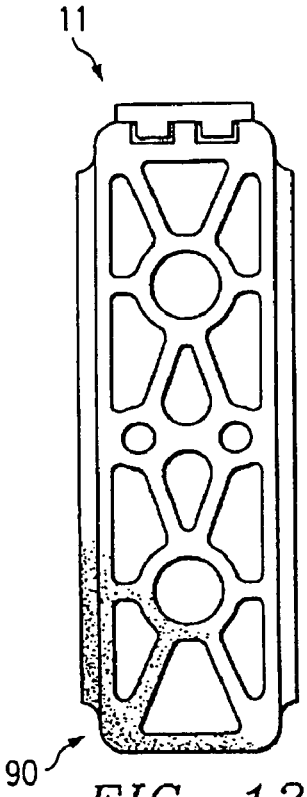
FIG. 12 is a plan view, in section, of the structural foam spacer block illustrated in FIG. 10 showing a cellular core and an integral solid skin, wherein the transition from skin to cellular core is gradual, according to the teachings of the present invention.
Figure 13:
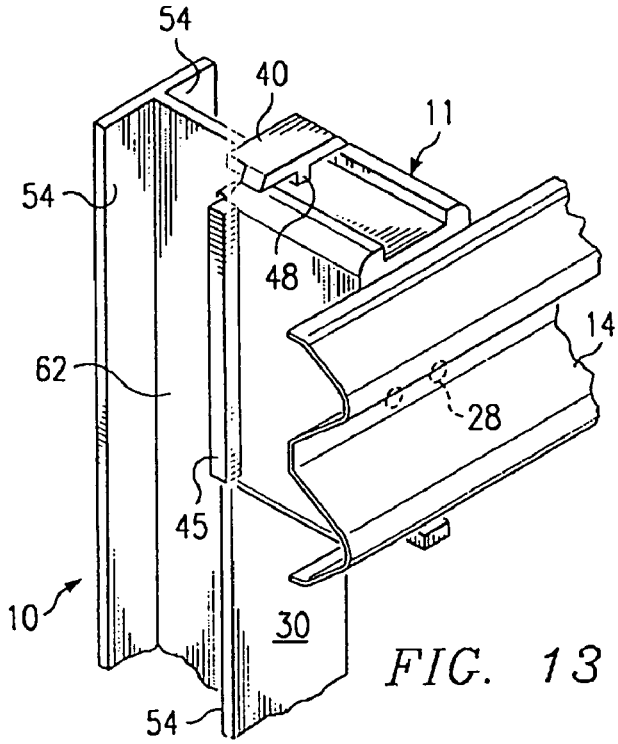
FIG. 13 is a perspective view showing a portion of a two-crown guardrail roadway safety barrier system incorporating a structural foam spacer block according to the teachings of the present invention.
Figure 14:
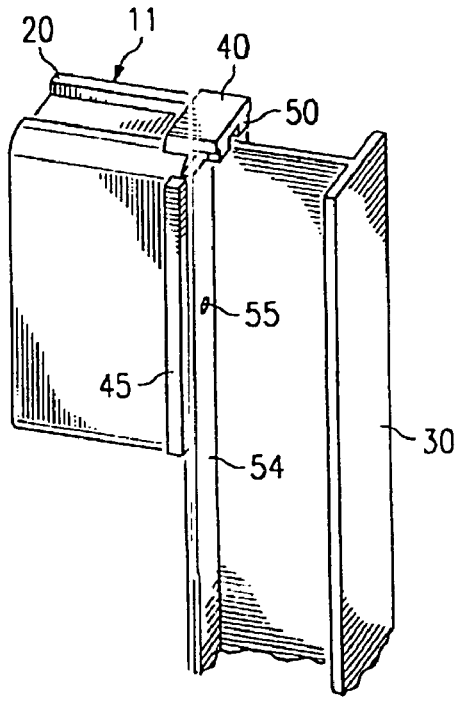
FIG. 14 is a perspective view of a guardrail support assembly incorporating a structural foam spacer block according to the teachings of the present invention.

As illustrated in FIGS. 3 and 5, spacer block 11 may include a top cavity 34 and a bottom cavity 36 separated by a medial wall 38 horizontally disposed between front face 12 and rear face 16. A pair of mounting bores 28 are preferably disposed proximate to or through medial wall 38. Corded-out cavities 34 and 36 may be reinforced with webbing, solid block materials, gel material, foam, or liquids such as water or glycol, as well as mixtures thereof to aid in the dissipation of stress or impact force.

As mentioned above, one embodiment of spacer block 11 preferably includes a pair of mounting bores 28 formed through medial wall 38. Mounting bores 28 are preferably oriented horizontally, travelling between front face 12 and rear face 16, side by side, to facilitate alignment of the one or more mounting bores 28 with the one or more offset holes 55 preformed in a typical support post 30. Orienting mounting bores 28 as described preferably enables a single installer to position the mounting bores 28 for quick alignment and attachment of a spacer block 11 and guardrail 14 to support post 30.

As illustrated, spacer blocks 11 may include at least one and preferably a plurality of mounting bores 28 extending through front face 12 for cooperative engagement of an attachment mechanism 13 extending through guardrail 14 and spacer block 11, securing their attachment to support post 30. In a preferred embodiment, mounting bores 28 extend through both front face 12 and rear face 16. In addition, mounting bores 28 may extend through medial wall 38 connecting front face 12 and rear face 16. According to teachings of the present invention, a sleeve 32 formed from a cylinder having a bore therethrough may be used as a removable spacer means for insertion between a hole formed in front face 12 and rear face 16. Sleeve 32 preferably abuts an interior surface of front face 12, extends through a cavity formed in the interior of spacer block 11, interconnects with an interior surface of rear face 16 and provides additional structural support.

Spacer block 11, as mentioned above with reference to FIGS. 1 through 4, preferably also includes a top tab 40 fixedly attached to top panel 20. Tab 40 may also be provided as a removable or slidable tab having projections for cooperatively engaging grooves formed in channel 43, such as in a tongue and groove arrangement. Tab 40 preferably extends beyond rear face 16 of spacer block 11 such that spacer block 11 may be engaged with the top of a support post 30 and depend therefrom, see FIGS. 1 through 2*b* and 13 through 15. In alternate embodiments, positioning or engagement tab 40 may comprise a flat plate, a ring to engage a cylindrical post or any other form useful for engaging support post 30 of different configurations according to teachings of the present invention.

The embodiment of engagement tab 40 shown in FIGS. 1 through 5 includes projecting members or fingers 50 extending downward from tab 40, enabling tab 40 to rest on, be positioned on, or otherwise engage the top of an I-beam shaped support post 30. In such engagement, fingers 50 preferably extend behind flange 54 of support post 30 to thereby hold spacer block 11 proximate a mounting position on support post 30.

Figure 4:
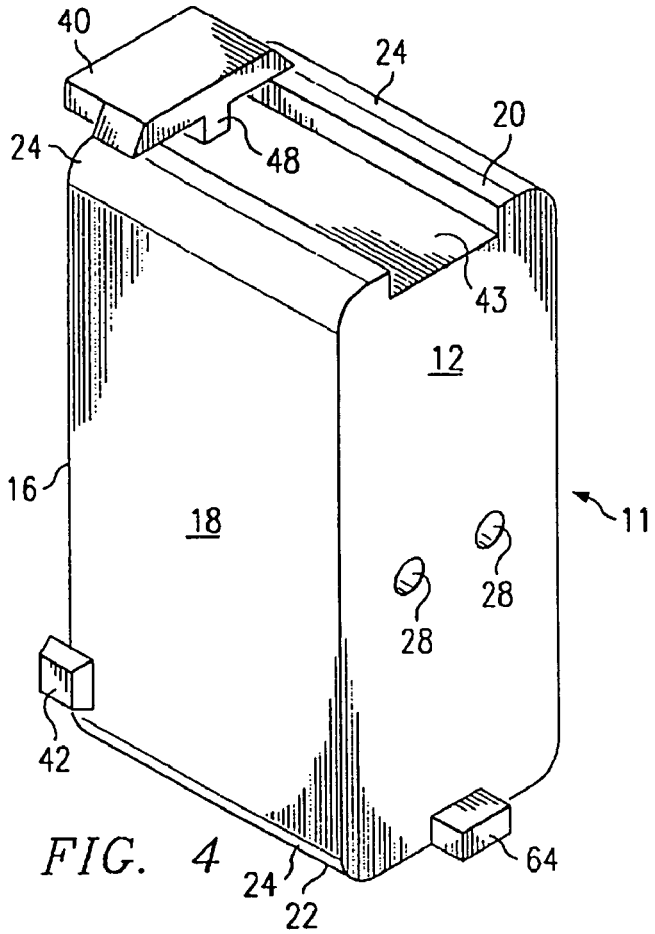
FIG. 4 is a perspective view of the spacer block depicted in FIG. 3 showing a front and side of the spacer block according to teachings of the present invention.
Figure 10:
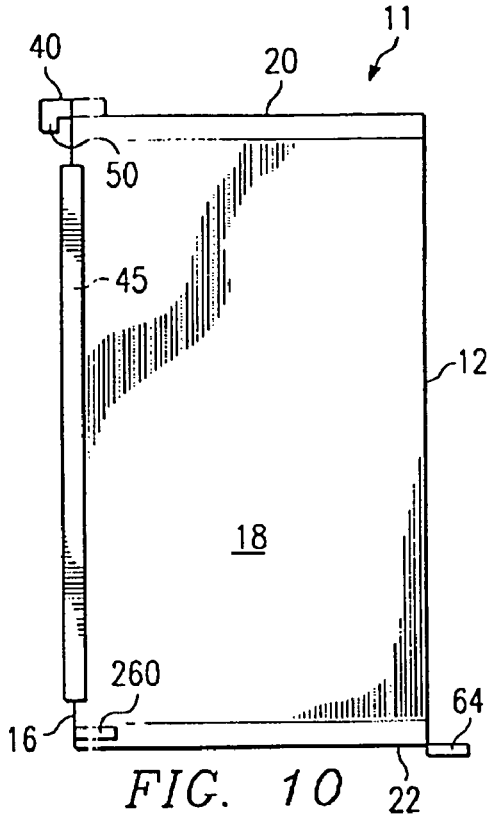
FIG. 10 is a side view of a spacer block formed from structural foam according to teachings of the present invention.

To facilitate a movable positioning tab 40, a groove or channel 43 may be formed or cut in top panel 20 on spacer block 11. As shown in FIG. 4, a leg 48 that extends from a bottom surface of tab 40 and movably engages the top of the channel 43 to provide additional structural support to tab 40 may also be included.

As shown in FIG. 5, first and second channels, 56 and 58 respectively, may be formed in top panel 20 of spacer block 11. Tabs 41 and 46 may be provided, attached to the top surface of top panel 20, and preferably extend beyond rear face 16 of spacer block 11. Similar to top tab 40, tabs 41 and 46 are preferably operable to hold spacer block 11 proximate the top of support post 30 in a mounting position.

Tabs 41 and 46 may also be fabricated such that each is removable or slidable using projections (not expressly shown) to cooperatively engage grooves formed as channels 56 and 58 in a tongue and groove arrangement. Similar to top tab 40, tabs 41 and 46 preferably extend beyond rear face 16 of spacer block 11 and are preferably operable to hold spacer block 11 onto the top of a support post 30. Thus, top tab 40 and tabs 41 and 46 preferably allow a spacer block 11 to hang or depend from a support post 30 during installation of a roadway safety barrier system 10.

A stop means may be incorporated within channels 43, 56 and 58 or attached to the ends thereof. Such a stop means may be desirable to restrict the movement of slidable tabs 40, 41 and 46.

A feature which is very useful and adaptable to the various spacer block 11 embodiments of the present invention are locating and holding or attachment means for cooperatively engaging support post 30 and/or guardrail 14.

As shown in FIGS. 2*a* and 3, one or more side tabs 42 may be used with the spacer blocks 11 of the present invention for cooperatively engaging the vertical sides or flanges 54 of support post 30 and limiting the lateral movement of at least a portion of the spacer block 11. Alternate embodiments of side tabs 42 are illustrated in FIGS. 6 through 14 as side flanges 45. Side tabs 42 or side flanges 45 are preferably spaced apart such that they are generally aligned and generally oppose one another. It is not required that side tabs 42 or side flanges 45 align with one another or that there be a corresponding number of each on the respective sides of spacer block 11. The inclusion of at least one side tab 42 or side flange 45 aids in positioning spacer blocks 11 with respect to the vertical sides or flanges 54 of support post 30. Side tabs 42 or side flanges 45 may be integrally formed on spacer block 11 or attached by a holding means such as a screw or projection for engaging a hole (not expressly shown) formed in spacer block 11. Spacer block 11 may be readily aligned to its proper orientation or in a mounting position through the aid of side tabs 42 or side flanges 45 and tab 40.

Spacer block 11 preferably also includes a support tab 64 operable to support or rest at least a portion of a guardrail 14 thereon. As shown in FIGS. 4, 6, 7 and 10, tab 64 may be provided as an extension from bottom panel 22 or front face 12. Alternate positions of support tab 64 are considered within the scope of the present invention. By allowing guardrail 14 to rest on support tab 64, the alignment of mounting bores 28 with one or more holes in guardrail 14 and support post 30, and the installation of the same, may be simplified.

Figure 7:
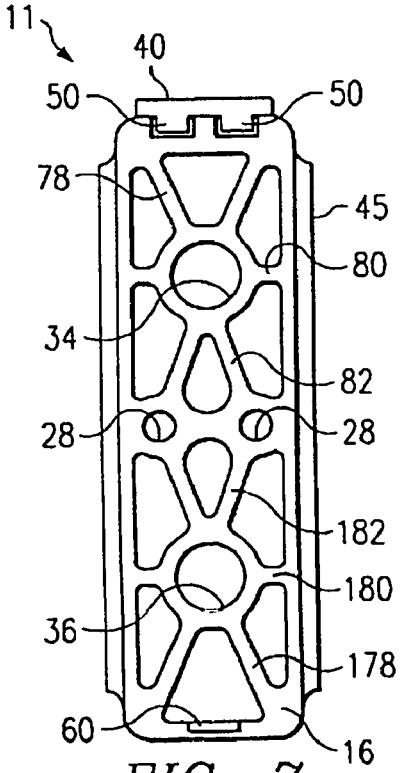
FIG. 7 is a plan view showing an alternate webbing arrangement for a spacer block according to teachings of the present invention.

To permit stacking or nesting of stored spacer blocks 11, as illustrated in FIGS. 3, 7 and 9, a recess or notch 60 may be formed or cut into bottom panel 22, proximate rear face 16. Notch 60 preferably allows for the cooperative engagement of support tab 64 therewith such that spacer blocks 11 may be positioned one upon the other for storage, transport or other purposes.

Spacer block 11 may be formed or molded such that front face 12 is slightly shorter than rear face 16, resulting in top panel 12 and bottom panel 22 inclining toward one another slightly (not expressly shown) at front face 12 to facilitate the removal of spacer block 11 from the mold. Notch or recess 60 of spacer block 11 may also be formed on bottom panel 22 as a declining channel extending from rear face 16 toward front face 12 and preferably does not extend through an interior surface of bottom panel 22.

Spacer blocks 11 built in accordance with teachings of the present invention may be molded into specific embodiments enabling the maximization of structural integrity while maintaining controlled flexibility. These traits may be leveraged by using, among other options, reinforcing webbing, and various rubber and thermoplastic compositions.

Figure 6:
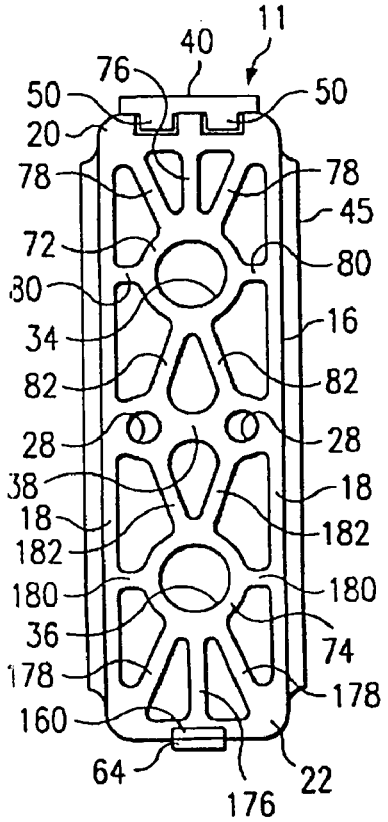
FIG. 6 is a plan view showing the front of one embodiment of a spacer block according to teachings of the present invention.

FIGS. 6 and 7 show alternate embodiments of spacer block 11 of the present invention using webbing within top cavity 34 and bottom cavity 36. Two reinforcing webbing configurations are shown in FIGS. 6 and 7. As illustrated, rear face 16 of spacer block 11 shows webbing formed by combining various lengths of lateral, longitudinal, and transverse members having cavities thereinbetween. The members are preferably positioned to increase structural strength while aiding spacer block 11 in the control of compression and flexing forces. A webbed reinforcement structure preferably also contributes to minimizing the weight of spacer block.

As shown in FIG. 6, one embodiment of spacer block 11 preferably includes webbing which extends from an interior surface of front face 12, through cavity 34 and/or 36, and having a distal end equal in length to side-walls 18, terminating to form rear face 16. In such a webbing configuration, preferably extending from a center of first cavity 34 from the interior surface of front face 12 is first cylindrical reinforcement member 72. A corresponding second cylindrical reinforcement member 74 is preferably included extending from the interior surface of front face 12 through second cavity 36. In each of cavities 34 and 36, the webbing preferably comprises runners extending from first and second cylindrical reinforcing members, 72 and 74 respectively, to the interior surfaces of side-walls 18, top panel 20, bottom panel 22 and medial wall 38.

Specifically as shown in FIG. 6, within first cavity 34, first runner 76 preferably extends between top panel 20 and cylindrical reinforcing member 72. A pair of second runners 78 preferably extend between cylindrical reinforcing member 72 and the corners connecting top panel 20 with side-walls 18. A pair of third runners 80 preferably extend between cylindrical reinforcing member 72 and side-walls 18. A fourth pair of runners 82 preferably extend between cylindrical reinforcing member 72 and medial wall 38, forming a teardrop shaped cavity thereinbetween.

Within second cavity 36 of spacer block 11, illustrated in FIG. 6, is a first runner 176 preferably extending between bottom panel 22 and cylindrical reinforcing member 74. A pair of second runners 178 preferably extend between cylindrical reinforcing member 74 and the corners connecting bottom panel 22 with side-walls 18. A pair of third runners 180 preferably extend between cylindrical reinforcing member 74 and side-walls 18. A fourth pair of runners 182 preferably extend between cylindrical reinforcing member 172 and medial wall 38, forming a teardrop shaped cavity thereinbetween.

The spacer block 11 embodiment illustrated in FIG. 7 has dimensions, features, and webbing similar to the embodiment of spacer block 11 illustrated in FIG. 6. However, the embodiment of spacer block 11 illustrated in FIG. 7 differs from that illustrated in FIG. 6 in that the reinforcement webbing illustrated in FIG. 7 does not utilize runner 76 extending between top panel 20 and cylindrical reinforcing member 74 or the vertical runner 176 extending between bottom panel 22 and cylindrical reinforcing member 74. In addition, the embodiment of spacer block 11 depicted in FIG. 7 includes notch 60 formed in bottom panel 22, proximate rear face 16. As illustrated, notch 60 preferably forms a pocket and does not cut through an exterior surface of bottom panel 22.

Illustrated in FIG. 8 is an elongated embodiment of a spacer block 11 designed for use with thrie-beam guardrails. Illustration of one embodiment of a roadway safety barrier system 10 using one embodiment of a thrie-beam spacer block 11, as shown in FIG. 8, is depicted in FIG. 15. Elongated spacer block 11 of FIG. 8 preferably includes additional third cavity 35, medial wall 138 and mounting bores 128, disposed between first cavity 34 and second cavity 36. Thrie-beam spacer block 11 of FIG. 8 preferably utilizes substantially the same reinforcing webbing configuration illustrated in FIG. 6. A spacer block 11 designed for use with a thrie-beam guardrail 15, illustrated in FIG. 15, is preferably approximately four (4) inches wide, about twenty-one (21) inches long, and about seven and one-half (7½) to eight (8) inches thick. The depth, length or other dimensions may vary to correspond with the dimensions of a selected guardrail or support post. However, the four (4) inch wide dimension, although not critical, is preferably maintained at about four (4) inches or approximately equal to the thickness of support post 30, excluding side flanges 45 or side tabs 42.

Preferably included within third cavity 35 of elongated spacer block 11 is a pair of runners 278 extending between cylindrical reinforcing member 272 and medial wall 38, forming a teardrop shaped cavity thereinbetween. A pair of runners 280 preferably extend between cylindrical reinforcing member 272 and side-walls 18. A pair of runners 282 preferably extend between cylindrical reinforcing member 272 and medial wall 138, forming a teardrop shaped cavity thereinbetween.

The structural integrity of the various embodiments of the spacer blocks 11 of the present invention may be attributed to the lightweight composite materials and the reinforcing webbing which preferably provide for rigidity and controlled compression of spacer blocks 11 under load.

FIG. 9 shows a second elongated embodiment of spacer block 11 for use with thrie-beam guardrails. See FIG. 15 for one embodiment of a roadway safety barrier system 10 capable of using a thrie-beam spacer block 11 as shown in FIG. 9. As illustrated in FIG. 9, elongated spacer block 11 may include third cavity 35, medial wall 138 and mounting bores 128, disposed between first cavity 34 and second cavity 36. The elongated spacer block 11 of FIG. 9 preferably utilizes substantially the same webbing configuration as the "W" guardrail spacer block 11 embodiment illustrated in FIG. 7. Similar to the elongated spacer block 11 embodiment of FIG. 8, the thrie-beam spacer block 11 illustrated in FIG. 9 is preferably approximately four (4) inches wide, about twenty-one (21) inches long, and about seven and one-half (7½) to eight (8) inches thick. As mentioned above, the depth, length or other spacer block 11 dimensions may vary to correspond to the dimensions of a selected guardrail 15 and/or support post 30. However, the four inch (4) wide dimension, although not critical, is preferably maintained at about four (4) inches or approximately equal to the thickness of a support post 30, excluding any side flanges 45 or side tabs 42.

In addition to or in place of the webbed reinforcement structures described above, it is contemplated that all or at least a portion of a spacer block may be filled with foam, gel, finely ground solid material, or a liquid such as water, alcohol or glycol. Alternatively, one or more of cavities 34, 35 or 36 may contain a bag filled with one or more materials to cushion and absorb impact with a roadway safety barrier system. The materials that may be contained within spacer block 11 or included in a container inserted into the webbing or into one or more of cavities 34, 35 or 36 formed within spacer block 11 may be removable, such as through the use of a water bag or a deformable plastic container such as a jug. In addition, a cellular core may be used for impact absorption within cavities 34, 35 or 36, just as an impact absorbing block filled with cellular material, gel, or a liquid may be disposed within one or more cavities 34, 35 or 36 of spacer block 11 according to teachings of the present invention.

Figure 16:
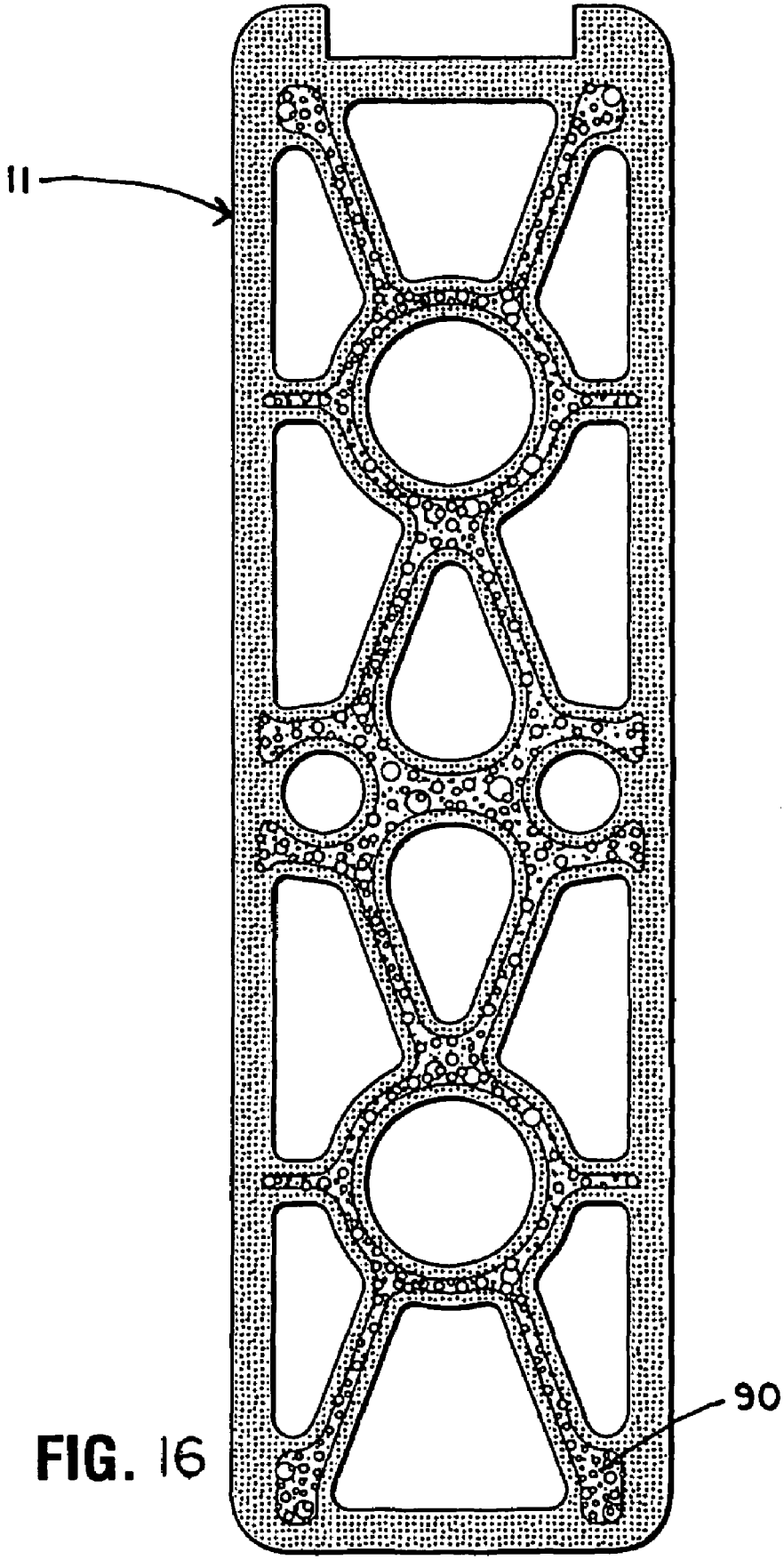
FIG. 16 is a plan view, in section, of a structural foam spacer block showing a cellular core and an integral solid skin, wherein the transition from skin to cellular core is gradual, according to the teachings of the present invention.

As mentioned above, spacer blocks 11 made in accordance with teachings of the present invention may incorporate a variety of materials into their construction. One embodiment of a spacer block 11 incorporating teachings of the present invention incorporates structural foam into its composition. A structural foam spacer block 11 incorporating teachings of the present invention, such as the structural foam spacer blocks 11 illustrated in FIGS. 10 through 14, is preferably molded and preferably includes a cellular core and an integral solid skin, wherein the transition from skin to core is preferably gradual, as shown generally at 90 in FIGS. 11, 12, and 16. The solid skin preferably gives a molded spacer block 11 its form and toughness, while the cellular core preferably contributes to the attainment of high strength-to-weight characteristics. In one embodiment, the skin of a structural foam spacer block 11 may be up to one-half (½) inch thick. Preferred skin thicknesses range down from one-quarter (¼) inch thick to one-eighth (⅛) inch thick.

In general, there are two basic types of plastics available for creating structural foam spacer blocks 11, thermoset materials and thermoplastic materials. Thermoset materials, such as polyurethane, may be produced by polyaddition of reactive components such as polyol and isocyanate. Thermoplastic materials typically require the addition of physical or chemical blowing agents to produce foam and do not undergo chemical change. Some blowing agents decompose when heated to process temperature to evolve a gas such as carbon dioxide. (During processing, the exotherm generated by the reaction vaporizes a blowing agent that causes the mixture to expand.) Often, sodium bicarbonate or ammonium carbonate is used to form cellular or sponge rubber. Halocarbons and methylene chloride may be used in urethane, pentane in expanded polystyrene, and in some cases, hydrazine for foamed plastics.

Spacer blocks 11 using plastic and/or rubber components are generally limited to solid wall thicknesses of about four (4) millimeters. The wall thickness of a structural foam spacer block 11 using plastic and/or rubber components, on the other hand, is preferably not less than about four (4) millimeters in order to gain full advantage of a foam webbing structure between two layers of skin. Thus, greater overall wall thickness may be obtained by using structural foam. Additionally, structural foam spacer blocks 11 have few, if any, sink marks due to residual gas pressure in the cells. This allows the material to expand internally during cooling of the part while holding the skin firmly against the mold walls.

Because of their cellular structure, spacer blocks formed from structural foam are virtually stress-free, resulting in bowing and warping being greatly reduced. In addition, because of its cellular structure, less resin is required during fabrication, which results in a part three (3) to four (4) times more rigid than a solid part of the same weight. Consequently, spacer blocks 11 made in accordance with teachings of the present invention may be made from commodity plastics such as polystyrene and polyethylene with or without rubber in a load bearing application.

Properties of a structural foam spacer block 11 depend on the base polymer, overall part density, density distribution, skin thickness, cell shape and size, among other variables. Each of these variables may be affected by the processing method, process variables, wall thickness, and mold design.

The density of structural foam generally varies across its cross section and is typically lowest in the core. As the distance from the center of a foam block increases, the cells generally get smaller until they "disappear" near the outer skin, see generally at 90 in FIGS. 11 and 12. One objective of such a composition is to produce a part with high skin density, low core density and without the presence of voids. The range of available densities varies in the present invention from about thirty (30) percent in the center to one hundred (100) percent at the outer skin. Also, the overall part density, density distribution, skin thickness, cell shape and size depend upon the mold cycle which may vary between one-half (½) to ten (10) minutes.

A preferred embodiment of spacer block 11 may be formed with a low-pressure injection molding machine using thermoplastics and/or rubber. A screw may be used to plast-icate a mixture of polymer and up to one (1) percent chemical blowing agent, preferably up to one-half (½) percent, wherein the screw barrels have zones maintained at different temperatures and are arranged so that the blowing agent is maintained near the nozzle. A foamable mixture may thereby be produced, pumped under pressure to an accumulator and stored in a molten state at a pressure higher than the foaming pressure. Upon opening a valve in the nozzle, a portion of the foamable mixture may be discharged from the accumulator into the mold. The mold cavity is then filled by the gases generated by the decomposition of the chemical blowing agent, forcing the material into the shape of the mold. The pressure and temperature of the material in the mold then drop, resulting in bubbles developing in the core. In a preferred embodiment, the melt is charged at about four hundred (400) degrees Fahrenheit and the melt temperature is between about three hundred and eighty (380) degrees Fahrenheit to four hundred and fifty (450) degrees Fahrenheit. It should be noted that structural foam spacer blocks 11 made in accordance with teachings of the present invention may be made from a rubber compound in combination with a plastic. Preferably, the plastic will encapsulate the rubber particles and act as a binder. The rubber preferably produces enough gas during processing under the heat and pressure of the low-pressure injection molding process that the structural foam product can be made without the addition of any type of chemical blowing agent.

Spacer block 11 of the present invention may be formed by injection molding, preferably low-pressure injection molding, such as is used for structural foam products. Spacer block 11 may include virgin or regrind plastic or combinations thereof without any rubber. The plastic may be selected from such polymers as polyethylene, polypropylene, polyethylene terephthalate, nylon, polyurethane, polyvinyl chloride, ABS, Acetyl, polypropylene oxide, nylon, PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. The spacer block 11 of the present invention may be formed from a single type of polymer or mixtures of various polymers. Typically a chemical blowing agent in an amount less than five (5) percent, and preferably in an amount less than one (1) percent and preferably in an amount less than one-half (½) percent may be used with one hundred (100) percent polymer composition spacer blocks 11.

A rubber and/or elastomeric compound may be incorporated in the formulation as a substitution for up to seventy (70) percent, and more preferably less than fifty (50) percent and most preferably from about forty (40) to fifty (50) percent depending upon the strength to weight ratio desired and the structural properties required for a particular application or size of guardrail. Regrind rubber is typically less expensive than plastic materials. Therefore, as much as forty (40) to fifty (50) percent regrind rubber may be used in a spacer block designed for normal impact applications or support posts 30 spaced close together. A composition with less than forty-five (45) percent rubber may be desirable for applications requiring support posts 30 to be spread further apart from one another. The type of rubber may also be an important consideration in that the rubber may be comprised of a natural rubber or synthetic rubber, either virgin material, regrind material or combinations thereof. Additives such as fillers and fiberglass may further reduce the cost of manufacture and provide the requisite strength. Because of the gases produced during injection molding of the rubber particles, the use of a chemical blowing agent is an option and is not required when processing the plastic and rubber mixed compositions.

One material that may be used in the construction of spacer block 11 comprises one or more polymers (such as polyethylene, polypropylene, polyethylene terephthalate, nylon, polyurethane, polyvinyl chloride, and mixtures thereof), and a polymer and rubber blend. Other plastic materials which may be used include, but are not limited to, ABS, Acetyl, polypropylene oxide, nylon PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. Spacer block 11 may also be formed from a single polymer or mixtures of various polymers. The polymers used may be virgin material or polymers including regrind materials, such as reground polyethylene, ethylene. The rubber and/or elastomeric compound that may be incorporated may also include a natural rubber or synthetic rubber, either virgin, regrind material or combinations thereof. It is contemplated that fiberglass may also be used as an additive or substitute raw material for all or at least a portion of the plastic material. Fillers such as wood chips, sawdust, calcium carbonate may also be used. The rubber from used tires that has long been a problem for the environment may also be used as a source of rubber for the present invention. In a variety of embodiments, the spacer blocks themselves may be recyclable.

Another embodiment of the present invention comprises polyethylene together with regrind rubber ranging in an amount of up to forty-five (45) percent. Yet another more preferred embodiment utilizes from about thirty (30) to forty-five (45) percent regrind rubber and utilizes ethylene as the binding polymer.

Yet another embodiment utilizes a powdered processing aid from Polymer Process Technologies, Inc. in Akron, Ohio referred to by the trademark PPT-SYS, (PPT-SYS® for rubber applications and PPT-SYS(P) for plastic applications), having a specific gravity of about one and one-one hundredth (1.01), a pH of about seven (7), and a melting point range of over six hundred (600) degrees Fahrenheit. Each of these powdered processing aids is a highly effective alloying agent for compatibilizing and alloying cured rubber, virgin or regrind, to form compounds having little or no change in physical properties.

Still another embodiment of spacer block 11 includes a blend of at least one polymer having among its ingredients one or more of the plastic materials set forth herein mixed and molded together with at least one rubber or elastomeric material. The ability to mold large blocks of plastic containing virgin and/or regrind thermoplastics obtained from such sources as reusable containers, alone or together with virgin or grind rubber from used tires or other sources, provides a useful means for the disposal and recycling of waste products. One embodiment utilizes grind rubber in combination with one or more thermoplastics extruded or molded by low-pressure injection molding or vacuum forming. The molding process is believed to encapsulate the rubber particles with the thermoplastic melt thereby providing a stronger blended product with enhanced performance capabilities as compared to a simple mixture of thermoplastic and rubber particles compressed together under high pressure. One source of the grind rubber is used vehicle tires, as indicated above, representing a new method of disposal for used tires.

Another embodiment may contain a non-toxic blend of naturally occurring materials, (plant polymers, gums, and anionic salts), marketed by Polymer process Technologies, Inc., under the trademark of PPT-RNU. When added to post consumer plastics of all kinds, PPT-RNU will typically repair heat history plastics to near virgin polymer condition in addition to or instead of the PPT-SYS (R)/(P). This material has a pH of about six and eight-tenths (6.8), a specific gravity of about one and five-hundredths (1.05), a melting point flow of over six hundred and fifty (650) degrees Fahrenheit, and it's generally used in amounts of up to ten (10) percent by weight, and more preferably, from about three (3) percent to about six (6) percent by weight.

Another embodiment utilizes both the PPT-RNU and PPT-SYS additives with rubber and a polymer, such as polyethylene, to enhance the compatibility and performance of regrind rubber from tires being compounded with virgin or recycled polymers such as polyethylene in conventional compounding equipment at processing temperatures of from about three hundred and sixty (360) degrees Fahrenheit to four hundred and ten (410) degrees Fahrenheit which is typical for extrusion and compounding operations.

Although the present invention has been described with respect to a specific preferred embodiment thereof, various changes and modifications may be suggested to one skilled in the art and it is intended that the present invention encompass such changes and modifications fall within the scope of the appended claims.

I claim:

1. A spacer block for attaching a guard rail to a post, comprising:

a pair of spaced apart opposing side walls having respective first ends and second ends;

a top panel disposed proximate the first end of said side walls;

a bottom panel disposed proximate said second end of said side walls;

said top panel, said bottom panel and said side walls forming a generally rectangular block having a first front face and a second rear face;

an engagement mechanism operably coupled proximate said top panel, said engagement mechanism operable to engage said spacer block with said post, the engagement mechanism including a tab operably coupled to the top panel, the tab extending beyond the second rear face of the spacer block, at least two spaced apart fingers operably coupled proximate a distal end of the tab, the fingers extending from a bottom surface of the tab and forming a gap between the fingers and the second rear face of the spacer block, the gap between the fingers operable to engage respective sides of a web on an I-beam support post and the gap between the fingers and the second rear face of the spacer block operable to engage respective sides of a flange on the I-beam support post;

at least one mounting bore extending therethrough said spacer block from said first front face to said second rear face; and an alignment mechanism operably coupled to at least one side wall.

2. The spacer block of claim 1 wherein said side walls comprise an inner skin and an outer skin including a structural foam thermoplastic composition therebetween wherein a density of a plurality of foam cells is denser near said inner skin and said outer skin than at a center position between said inner skin and said outer skin.

3. The spacer block of claim 1, comprising a structural foam thermoplastic and rubber composition wherein the density of the foam is greater toward said side walls.

4. The spacer block of claim 3, wherein a solid content of said composition increases from 30 percent in the center to 100 percent at said side walls.

5. The spacer block of claim 1 further comprising a resting mechanism operably coupled proximate said bottom panel for supporting a bottom edge of a guard rail thereon.

6. The spacer block of claim 1 wherein said top panel, said bottom panel, said side walls, said first front face, and said second rear face further include structural foam comprising a foam core webbing disposed between an inner and an outer solid plastic skin.

7. The spacer block of claim 1 further comprising external webbing comprising a least one runner extending radially from a cylindrical reinforcing member intersecting with an interior surface of said top panel, said bottom panel and said side walls extending between at least one void space formed in said spacer block.

* * * * *